US006187736B1

(12) United States Patent
Jarema

(10) Patent No.: US 6,187,736 B1
(45) Date of Patent: Feb. 13, 2001

(54) SOLVENT MIXTURES SUITED FOR USE WITH WIPING CLOTH ON AUTO BODIES

(75) Inventor: Chester P. Jarema, Sterling Heights, MI (US)

(73) Assignee: Henkel Corporation, Gulph Mills, PA (US)

( * ) Notice: Under 35 U.S.C. 154(b), the term of this patent shall be extended for 0 days.

(21) Appl. No.: 09/266,257

(22) Filed: Mar. 11, 1999

Related U.S. Application Data

(60) Provisional application No. 60/077,787, filed on Mar. 11, 1998.

(51) Int. Cl.[7] ..... C11D 3/22; F02B 77/04

(52) U.S. Cl. ..... 510/245; 510/185; 510/189; 510/201; 510/202; 510/365

(58) Field of Search ..... 510/130, 417, 510/424, 428, 463, 466, 365, 422, 291, 505, 506, 206, 189, 185, 201, 202, 245

(56) References Cited

U.S. PATENT DOCUMENTS 3,661,641 * 5/1972 Vigh et al. ..... 134/6
5,595,786 1/1997 McBride, Jr. et al. ..... 427/299

FOREIGN PATENT DOCUMENTS

242619 * 2/1987 (DD) .
54729 * 3/1991 (HU) .
54-140741 * 11/1979 (JP) .
04327518 * 11/1992 (JP) .
408060531 * 3/1996 (JP) .
507624 * 4/1976 (SU) .
1208113 * 1/1986 (SU) .

* cited by examiner

*Primary Examiner*—Yogendra Gupta
*Assistant Examiner*—Gregory E. Webb
(74) *Attorney, Agent, or Firm*—Wayne C. Jaeschke; Stephen D. Harper; Norvell E. Wisdom, Jr.

(57) ABSTRACT

A solvent mixture comprising an alcohol, an aromatic hydrocarbon or an organic compound containing carboxyl but not hydroxyl moieties, and optionally and preferably a non-aromatic hydrocarbon or halohydrocarbon is particularly effective in removing incompletely cured residues of a variety of sealing compounds from the surfaces of automobile bodies, without damaging intermediate or final finish coatings for the automobile bodies. The solvent mixture may advantageously be absorbed in a wiping cloth for convenient use.

8 Claims, No Drawings

SOLVENT MIXTURES SUITED FOR USE WITH WIPING CLOTH ON AUTO BODIES

CROSS-REFERENCE TO RELATED APPLICATIONS

Priority is claimed under 35 U.S.C. § 119(e) from Application Serial No. 60/077,787 filed Mar. 11, 1998.

STATEMENT REGARDING FEDERALLY SPONSORED RESEARCH OR DEVELOPMENT

Not applicable.

BACKGROUND OF THE INVENTION

This invention relates to a mixed solvent that is especially suitable for use together with a wiping cloth to remove sealing compositions (alternatively called "sealers"), especially poly{vinyl chloride}, rubber, epoxy resin, and/or acrylic based sealers that are used in "body shop" and "paint shop" areas of automobile manufacturing plants, from the surfaces of automobile bodies at various stages of the manufacture of the auto bodies.

Sealing compositions are initially readily deformable solids, which alternatively could be called highly viscous liquids, that can easily be inserted into joints and the like. Sealing compositions are used during the manufacture of auto bodies before any general chemical treatment of the overall metal of which auto bodies are primarily constructed and often also at later stages, e.g., after one or more stages of painting. The method of use of the sealers is sufficiently imprecise that almost inevitably some of the sealer will be accidentally applied to some part of the automobile where it is not desired, along with the places where it should go. Also, the sealing compositions eventually are converted to no longer readily deformable solids during the course of manufacture of a complete automobile by the action of heat and/or lapse of time. In the course of this manufacture, residues from these sealing compositions, with varying degrees of deformability, can exude from the locations where they are desired to remain in the final product onto the parts of the auto body surfaces that need a decorative finish in the final automobile.

In order to prevent surface blemishes that might result from areas of sealer on the part of the surface of an automobile that is to be given a decorative finish, it is customary to wipe the auto body at several stages during the process of its complete manufacture with cloth or some similar soft, conformable, and retentively porous material that contains as absorbate a suitable solvent or solvent mixture to assist in transferring any portions of sealing composition(s) that could interfere with later decoration of the surface to the solvent containing wiping cloth, which is eventually discarded. The same or a similar type of wiping cloth is also used to remove dust from sanding at various stages of manufacture. Various solvents have been used for such wiping cloths in the past, but none has been entirely satisfactory.

One problem with the prior art solvents used for this purpose is that the same type of wiping cloth with the same solvent content is normally used throughout all stages of manufacture, including a wipe after the application of cationically electrodeposited paint, a step that is usually only one or two steps from the end of the process of completing the most decorative finish on an auto body exterior, and sometimes even a wipe of the very last decorative finish applied ("top coat"). Some solvents very readily dissolve the uncured sealer compositions, which usually include, for example, poly{vinyl chloride} and/or acrylic polymers, filler(s), and sometimes plasticizer(s). Such solvents would be very desirable to have in a wiping cloth used while most of the auto body surface is still bare metal, but such solvents are likely to attack the electrodeposited paint layer and any subsequent paint layer and therefore can not be used at that stage. Other problems with prior art solvents and solvent mixtures used in wiping cloths include: unpleasant odors; an evaporation rate that is too slow, so that solvent remains on the surface wiped more than about 30 seconds after wiping is finished, or too fast, so that most of the solvent is gone from the wiping cloth before the operator has finished the wiping operation; and fire hazard from the use of solvents with low flash points.

Accordingly, one major object of this invention is to provide a solvent mixture particularly useful in wiping cloths for the removal of poly{vinyl chloride} and/or acrylic based sealing compositions that will avoid or minimize at least one, and most preferably all, of the difficulties noted above that exist with prior art products. Other objects, which include provision of a wiping cloth incorporating this superior solvent mixture and processes for the use of the solvent and/or the wiping cloth, will be apparent from and be further explained in the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the description, unless expressly stated to the contrary: percent, "parts of", and ratio values are by weight or mass; the term "polymer" includes "oligomer", "copolymer", "terpolymer" and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ within the composition by chemical reaction(s) noted in the specification between one or more newly added constituents and one or more constituents already present in the composition when the other constituents are added, and does not preclude unspecified chemical interactions among the constituents of a mixture once mixed; specification of constituents in ionic form additionally implies the presence of sufficient counterions to produce electrical neutrality for the composition as a whole and for any substance added to the composition; any counterions thus implicitly specified preferably are selected from among other constituents explicitly specified in ionic form, to the extent possible; otherwise such counterions may be freely selected, except for avoiding counterions that act adversely to an object of the invention; the word "mole" means "gram mole", and the word itself and all of its grammatical variations may be used for any chemical species defined by all of the types and numbers of atoms present in it, irrespective of whether the species is ionic, neutral, unstable, hypothetical, or in fact a stable neutral substance with well defined molecules; and the terms "solution", "soluble", "homogeneous", and the like are to be understood as including not only true equilibrium solutions or homogeneity but also dispersions that show no visually detectable tendency toward phase separation over a period of observation of at least 100, or preferably at least 1000, hours during which the material is mechanically undisturbed and the temperature of the material is maintained within the range of 18–25° C.

BRIEF SUMMARY OF THE INVENTION

It has been found that a very advantageous solvent combination comprises, preferably consists essentially of, or more preferably consists of, the following components:

(A) a component selected from the group of alcohols; and (B) a component selected from the group of organic compounds that contain a carbonyl moiety or an aromatic ring moiety or both but do not contain any hydroxy moiety; and, optionally and preferably, (C) a component selected from the group of organic compounds that contain no atoms other than carbon, hydrogen, and halogen atoms and do not contain any aromatic ring; and, optionally, one or both of:

(D) water; and (E) a viscosity control agent.

BRIEF DESCRIPTION OF THE DRAWINGS

Not applicable.

DETAILED DESCRIPTION OF THE INVENTION

Each of the components (A), (B), and (C) independently and the solvent mixture according to the invention as a whole preferably are liquids at 25° C., or more preferably are liquids at 18° C. Also, independently, a solvent mixture according to the invention preferably has a flash point, measured by a standard closed cup method, that is at least, with increasing preference in the order given, −4.5, −4.0, −3.5, −3.0, −2.5, −2.0, −1.5, −1.0, −0.5, 0.0, 0.5, 1.0, 1.5, 2.0, 2.5, 3.0, 3.5, 4.0, 4.5, 5.0, 5.5, 6.0, 6.5, or 7.0° C.

Component (A) is preferably selected from alcohol molecules that contain a single —OH moiety in each molecule and independently preferably also, except for their —OH moiety or moieties, contain no atoms other than carbon, hydrogen, and ether oxygen, more preferably no atoms other than carbon and hydrogen. Also independently, the molecules selected for component (A) preferably contain not more than, with increasing preference in the order given, 6, 5, 4, 3, or 2 carbon atoms per molecule. The single most preferred molecule for component (A) is ethanol. Independently of its exact chemical nature, the amount of component (A) in a solvent mixture according to the invention preferably is at least, with increasing preference in the order given, 10, 20, 30, 40, 45, 50, 55, 60, 65, or 69% and independently preferably is not more than, with increasing preference in the order given, 95, 90, 85, 80, 77, or 75% of the total solvent mixture.

If a solvent mixture according to the invention is to be used under conditions in which static electric sparks and other sources of ignition can be adequately guarded against, component (B) may be satisfactorily and economically selected from aromatic hydrocarbons, optionally containing halogen or ether substituents. Benzene should normally be avoided because of its carcinogenicity, but toluene and the xylenes are highly suitable, with toluene most preferred.

In order to diminish the fire hazard, however, component (B) normally is preferably selected from molecules that, independently for each property stated: contain a single carbonyl group each; are ketones or esters; contain not more than, with increasing preference in the order given, 10, 8, 7, or 6 carbon atoms each and if they do not contain a tertiary carbon atom more preferably contain not more than 5 carbon atoms each; primarily for reasons of economy, contain no atoms other than carbon, oxygen, and hydrogen; and, primarily for reasons of economy, contain not more than, with increasing preference in the order given, 6, 4, 3, or 2 oxygen atoms each.

The presence of a tertiary carbon atom in each molecule of component (B) is advantageous under many circumstances because of lower pollution potential. Tertiary butyl esters and ketones, for example, can be exempt from legal regulation as "Volatile Organic Compounds" (often abbreviated as "VOC"). This is a substantial advantage in many operations, where emissions of VOC are legally limited and inadequate or no facilities for abating such emissions are in place. In such circumstances, ter-butyl acetate is the most preferred single ingredient for component (B). Except for pollution potential, however, n-propyl acetate is almost as satisfactory. Mixtures of these two esters can also be more effective than either of them alone in removing a variety of sealing compositions without unduly damaging any of the desired protective finishing layers that may underly the sealing compositions so that it is practically impossible to remove the sealing compositions without effecting contact between the solvent according to the invention and the protective finishing layer.

The corresponding methyl n-propyl ketone and methyl t-butyl ketone are at least as satisfactory as the corresponding esters as constituents of component (B) insofar as the cleaning power of mixtures according to the invention that contain them are concerned. However, the mixtures containing the ketones have lower flash points than the mixtures otherwise the same except for substituting esters for the ketones, and technical grade ketones normally contain more impurities subject to stringent pollution abatement requirements than do technical grade esters. The esters are therefore preferred for these reasons under most circumstances.

Independently of their exact chemical nature, components (A) and (B) are preferably present in a solvent mixture according to the invention in amounts such that the amount of component (B) has a ratio to the amount of component (A) that is at least, with increasing preference in the order given, 0.05:1.0, 0.10:1.0, 0.15:1.0, 0.20:1.0, 0.25:1.0, 0.30:1.0, or 0.33:1.0 and independently preferably is not more than 2.5:1.0, 2.0:1.0, 1.5:1.0, or 1.0:1.0 and, if component (B) consists predominantly of carbonyl group containing molecules rather than aromatic compounds, still more preferably is not more than, with increasing preference in the order given, 0.8:1.0, 0.60:1.0, 0.55:1.0, 0.50:1.0, 0.47:1.0, 0.44:1.0, 0.41:1.0, 0.38:1.0, or 0.36:1.0.

Component (C) is optional but is normally preferred because its presence is normally associated with a more agreeable odor for the mixture as a whole. Component (C) preferably is selected from molecules that, independently for each property stated: primarily for reasons of economy, contain no atoms other than carbon and hydrogen; contain at least one, or more preferably at least two, carbon—carbon double bonds per molecule; and in sufficient number for measurement of boiling point constitute a compound[1] that has a boiling point at normal atmospheric pressure that is at least, with increasing preference in the order given, 100, 120, 130, 140, 145, 150, 155, 160, 165, 170, or 175° C. Also, independently of these other preferences, component (C) preferably is present in a solvent mixture according to the invention in an amount that has a ratio to the amount of component (A) in the same mixture that is at least, with increasing preference in the order given, 0.003:1.0, 0.005:1.0, 0.007:1.0, 0.009:1.0, 0.011:1.0, or 0.013:1.0 and independently preferably is not more than, with increasing preference in the order given, 0.30:1.0, 0.25:1.0, 0.20:1.0, 0.17:1.0, 0.14:1.0, 0.12:1.0, 0.10:1.0, 0.090:1.0, 0.085:1.0, 0.080:1.0, or 0.075:1.0.

[1] This is not to be construed to mean that all of the molecules in component (C) must necessarily constitute the same compound, but merely that each type of molecule present, if present in sufficient number for measurement of a boiling point, would constitute a compound with the minimum boiling point specified.

Optional component (D) of water is useful primarily to reduce cost and increase flash point, but it diminishes effective cleaning of most types of sealants. Therefore, this component normally preferably constitutes not more than, with increasing preference in the order given, 25, 20, 15, 10, or 5% of the total solvent composition.

Optional component (E) of viscosity control agent may be used to give high viscosity at low shear rates in order to provide a non-dripping solvent mixture. Any of several types of "thickening agents" known in the art, such as natural and synthetic gums and latexes that increase substantially in viscosity upon pH change, may be used. Generally, however, any such thickening agent diminishes the effectiveness of a solvent mixture in removing most types of sealants and other soil from the surfaces to be cleaned with the solvent mixture, so that quantities of viscosity control agents should be limited to the minimum necessary to achieve the desired effect on viscosity.

Components (A) through (D) are not believed to undergo any chemical reaction among themselves and may be mixed in any order. If a viscosity control agent is used, it may be more sensitive to mixing order and preferably is treated as otherwise known in the art for the particular viscosity control agent used. For example, a thickening latex should normally be mixed with all other constituents of a solvent mixture before the pH varying agent that causes its viscosity increase is added.

Solvent mixtures may be used according to the invention in conjunction with any type of woven or non-woven cloth or similar material that is not degraded by the solvent mixture itself, in a manner generally known in the art and illustrated, e.g., in U.S. Pat. No. 5,595,786 of Jan. 21, 1997 to McBride, Jr., et al., the entire disclosure of which, to the extent that it is not contrary to any explicit statement herein, is hereby incorporated herein by reference. A non-woven cloth web containing both rayon and textile polyester fibers is particularly preferred.

This invention may be further appreciated from the following working examples, and its advantages may be appreciated from comparison with the other mixtures and one simple solvent described below.

Solvent mixtures, some of which are according to the invention, are described in Table 1 below. The mixtures in Table 1 were tested for various physical and chemical properties related to their intended use in wiping cloths for removing poly{vinyl chloride} and acrylic based sealing compositions from auto bodies. These results are shown in Table 2 below.

TABLE 1

| Mix. | Percent by Weight in Mixture of: | | | | | | | | | | | | |
|---|---|---|---|---|---|---|---|---|---|---|---|---|---|
| No. | Act. | MPGl | nPAc | d-Lim. | iPA | EA | $H_2O$ | nPA | tBAc | CP | DOA | Tol. | MiBK | MPK |
| 1 | | 100 | | | | | | | | | | | | |
| 2 | 15 | 80 | | | | | 5.0 | | | | | | | |
| 3 | 20 | 80 | | | | | | | | | | | | |
| 4 | 20 | | | 80 | | | | | | | | | | |
| 5 | 20 | | | 75 | | | 5.0 | | | | | | | |
| 6 | 10 | | | | 80 | | 10 | | | | | | | |
| 7 | 20 | | | | | | | 80 | | | | | | |
| 8 | 20 | | | | | | 5.0 | 75 | | | | | | |
| 9 | 20 | | | 5.0 | | | | 75 | | | | | | |
| 10 | 10 | | | 5.0 | | | | 75 | | | | 10 | | |
| 11 | | | 25 | 1.0 | | 74 | | | | | | | | |
| 12 | | | 25 | 5.0 | | 70 | | | | | | | | |
| 13 | | | | 5.0 | 75 | | | | | | | | 20 | |
| 14 | | | | 5.0 | | | | 45 | | | | 50 | | |
| 15 | | | | 5.0 | 45 | | | | | | | 50 | | |
| 16 | | | | 5.0 | 40 | | | | | | | 55 | | |
| 17 | | | | 5.0 | 30 | | | | | | | 65 | | |
| 18 | | | | 5.0 | | 70 | | | | | | | | 25 |
| 19 | | | 14 | 1.0 | | 60 | | | 25 | | | | | |
| 20 | | | 12.5 | 1.0 | | 70 | | | 12.5 | | | | | |
| 21 | | | 25 | 1.0 | | 66 | 7.8 | | | 0.5 | 1.0 | | | |
| 22 | 5.0 | | 9.0 | 1.0 | | 60 | | | 25 | | | | | |
| 23 | | | 21.2 | 0.8 | | 63 | 15 | | | | | | | |

Abbreviations and Other Notes for Table 1
"Mix. No." means "Mixture Number";
"Act."means "Acetone";
"MPGl" means "Propylene Glycol, Monomethyl Ether";
"nPAc" means "normal propyl alcohol";
"d-Lim." means "d-Limonene;
"iPA" means "Iso-Propyl Alcohol";
"EA" means "Ethyl Alcohol" (specifically technical anhydrous denatured ethyl alcohol, containing 95% ethanol and 5% iso-propyl alcohol);
"nPA" means "n-Propyl Alcohol";
"tBAc" means "ter-butyl acetate";
"CP" means "CARBOPOL ™ ETD-2690 polymeric thickening agent", a product commercially supplied by B. F. Goodrich, Specialty Polymers Division;
"DOA" means "di-(2-ethylhexyl)amine";
"Tol." means "Toluene";
"MiBK" means "Methyl iso-Butyl Ketone"; and
"MPK" means "Methyl n-Propyl Ketone".
A blank cell indicates no addition of the material that would correspond to that cell.

TABLE 2

| | Characteristic of Mixture with Respect to: | | | | |
|---|---|---|---|---|---|
| | Removal of Sealing Composition: | | | | |
| Mixture Number | 60 B-4 (Yellow) | ESB-M4G252E (White) | LG-337-A (Gray Epoxy) | Evaporation Rate of the Mixture | Other Properties |
| 1 | 80–90% | | | | |
| 2 | 5–10% | | | | |
| 3 | 100% | | | | |
| 4 | 100% | | | | |
| 5 | | | | | Two liquid phases |
| 6 | 0 | | | | |
| 7 | good | good | | good | |
| 8 | poor | good | | good | |
| 9 | good | good | | good | |
| 10 | 85–90% | good | | | |
| 11 | good | good | | good | Flash point 7.2° C. |
| 12 | good | good | | good | Flash point 8.9° C. |
| 13 | good | good | | | Odor disagreeable |
| 14 | good | good | | | Left bubbles when wiped on painted panel |
| 15 | good | | | good | |
| 16 | good | | | good | |
| 17 | good | good | | good | Flash point −4.4° C. |
| 18 | good | good | | good | Flash point 7.2° C. |
| 19 | excellent | | excellent | good | |
| 20 | good | | fair | good | |
| 21 | | | | | Flash point 1.1° C. |
| 22 | | | | good | |
| 23 | good | | fair | good | |

Note for Table 2
A blank cell indicates that the property at the column heading for the cell was not evaluated for the mixture number in the leftmost column of the same table row as the cell.

What is claimed is:

1. A liquid solvent mixture composition of matter that is suitable for use as an absorbate in a wiping cloth for removing automotive sealer compounds from undesired locations on automobile bodies, said composition comprising:

from about 69 to about 75% of ethanol;

an amount of n-propyl acetate, t-butyl acetate, or a mixture of n-propyl acetate and t-butyl acetate that has a ratio to the amount of ethanol that is in the range from about 0.30:1.0 to about 0.38:1.0; and an additional component (C) selected from the group consisting of molecules that:

contain no atoms other than carbon and hydrogen;

contain no aromatic ring;

contain at least two carbon-carbon double bonds; and in sufficient number, constitute a compound that has a boiling point at normal atmospheric pressure that is at least 175° C., said component (C) being present in the mixture in an amount that has a ratio to the amount of component (A) present in the same mixture that is from about 0.013:1.0 to about 0.075:1.0.

2. A wiping cloth containing a solvent mixture according to claim 1 absorbed therein.

3. A solid walled container that contains therein at least one wiping cloth according to claim 2 and optionally also contains a reservoir of the solvent mixture absorbed in the wiping cloth.

4. A process of preparing an automobile body surface for receiving a decorative finish thereon, said process comprising wiping the automobile body surface with a wiping cloth according to claim 2 in order to transfer a residue of sealing composition from the automobile body surface to the wiping cloth.

5. A liquid solvent mixture composition of matter that is suitable for use as an absorbate in a wiping cloth for removing automotive sealer compounds from undesired locations on automobile bodies, said composition having been made by mixing together at least the following components:

a first mass of ethanol that constitutes from about 69 to about 75% of the total liquid solvent mixture;

a second mass that consists of n-propyl acetate, t-butyl acetate, or a mixture of n-propyl acetate and t-butyl acetate and has a ratio to said first mass that is in the range from about 0.30:1.0 to about 0.38:1.0; and a third mass of a component (C) selected from the group consisting of molecules that:

contain no atoms other than carbon and hydrogen;

contain no aromatic ring;

contain at least two carbon-carbon double bonds; and in sufficient number, constitute a compound that has a boiling point at normal atmospheric pressure that is at least 175° C., said third mass having a ratio to said first mass that is from about 0.013:1.0 to about 0.075:1.0.

6. A wiping cloth containing a solvent mixture according to claim 5 absorbed therein.

7. A solid walled container that contains therein at least one wiping cloth according to claim 6 and optionally also contains a reservoir of the solvent mixture absorbed in the wiping cloth.

8. A process of preparing an automobile body surface for receiving a decorative finish thereon, said process comprising wiping the automobile body surface with a wiping cloth according to claim 7 in order to transfer a residue of sealing composition from the automobile body surface to the wiping cloth.

* * * * *